US008505470B1

(12) United States Patent
Lira

(10) Patent No.: US 8,505,470 B1
(45) Date of Patent: Aug. 13, 2013

(54) PORTABLE DESK

(76) Inventor: Gustavo A. Lira, West Palm Beach, FL (US)

( * ) Notice: Subject to any disclaimer, the term of this patent is extended or adjusted under 35 U.S.C. 154(b) by 177 days.

(21) Appl. No.: 13/071,928

(22) Filed: Mar. 25, 2011

(51) Int. Cl.
*A47B 11/00* (2006.01)

(52) U.S. Cl.
USPC .... 108/138; 108/10; 108/144.11; 108/158.12

(58) Field of Classification Search
USPC ..... 108/5–6, 10, 138, 147.19, 147.2, 108/147.21, 147.11, 144.11, 146, 150, 157.15, 108/158.12, 157.1; 248/395, 398, 454, 447, 248/432, 439, 440.1, 188, 188.2; 297/423.39, 297/423.41, 423.46
See application file for complete search history.

(56) References Cited

U.S. PATENT DOCUMENTS

| | | | | | |
|---|---|---|---|---|---|
| 337,876 | A | * | 3/1886 | Shepperd | 108/10 |
| 456,990 | A | * | 8/1891 | Hawley | 108/10 |
| 1,295,680 | A | * | 2/1919 | Benson | 108/4 |
| 1,381,477 | A | * | 6/1921 | Lauri | 108/4 |
| 1,493,891 | A | * | 5/1924 | Moore | 297/171 |
| 2,027,609 | A | * | 1/1936 | Nelson | 108/10 |
| 4,383,486 | A | | 5/1983 | Reineman et al. | |
| 4,703,701 | A | * | 11/1987 | Sema | 108/10 |
| 4,726,556 | A | | 2/1988 | Weir | |
| 4,947,763 | A | * | 8/1990 | Piorek | 108/8 |
| 4,978,096 | A | | 12/1990 | Struckmann | |
| 5,598,786 | A | | 2/1997 | Patterson | |
| 5,832,840 | A | * | 11/1998 | Woof | 108/6 |
| 6,019,050 | A | * | 2/2000 | Ranta | 108/6 |
| 7,594,475 | B1 | * | 9/2009 | Huang | 108/8 |
| 7,938,372 | B2 | * | 5/2011 | MacLeod | 248/122.1 |
| 2004/0060486 | A1 | * | 4/2004 | Franze et al. | 108/147.19 |

FOREIGN PATENT DOCUMENTS

| | | | |
|---|---|---|---|
| CH | 675347 | A5 * | 9/1990 |
| DE | 3801403 | A1 * | 8/1988 |
| EP | 355890 | A1 * | 2/1990 |

* cited by examiner

*Primary Examiner* — Hanh V Tran
(74) *Attorney, Agent, or Firm* — Malin Haley DiMaggio & Bowen, P.A.

(57) ABSTRACT

A portable desk sized to receive and support a conventional laptop computer or other objects such as a book The portable desk has a flat rigid rectangular desktop, a pair of curved lower legs connected to a pair of curved upper legs. The portable desk lower legs include a support surface for supporting said desk top in a stable position on a surface. The upper and lower legs have a pitch angle locking system for adjustably changing the pitch angle of the desk top using manually operated stoppers connected to the lower legs that engage notches on the curved upper legs for locking the desktop in place.

5 Claims, 4 Drawing Sheets

PORTABLE DESK

BACKGROUND OF THE INVENTION

1. Field of the Invention

This invention relates generally to a portable desk, and specifically to a portable desk that is sized to receive a laptop computer and includes a desk top support member to change the pitch and angle of the desktop.

2. Description of the Prior Art

With the introduction of laptop computers and notebook computers and wireless service, it is a common practice to utilize a laptop computer or notebook computer in a variety of different environments other than office or a residential office. It is possible to sit almost anywhere in order to utilize the laptop computer.

Various devices are shown in the prior art to support a laptop computer. U.S. Pat. No. 4,726,556 issued Feb. 23, 1988, shows an adjustable table for utilizing a laptop. Examples are shown in U.S. Pat. No. 5,598,786 issued Feb. 4, 1997, for a laptop desk and U.S. Pat. No. 6,019,050 issued Feb. 1, 2000, for an adjustable table. These devices are not very portable and for their purpose are complex in structure.

The invention described in this application provides a portable desk that has a non-complex structure to easily change the pitch and angle of the desktop especially for supporting a laptop computer or notebook computer or book.

SUMMARY OF THE INVENTION

A portable desk comprising a rigid flat planar surface, rectangularly shaped with rounded edges, and a pair of curved telescopically adjustable rigid legs, each of said legs connected at one end to one side of said rigid planar surface and each leg having a flat base member.

Each leg includes a lower leg member and an upper leg member telescopically joined such that the upper member fits into a recessed channel in the lower member. The upper leg member is also movably connected to the lower leg member in the recessed channel so that the upper leg member can be manually positioned relative to the lower leg member. The upper leg member is shaped arcuately, as is the lower leg member's recessed channel. The upper leg member can be locked in place with a stopper locking pin that fits into notches made in the upper leg lateral wall. Thus, the angle pitch made by the rigid surface can be manually adjusted relative to the base by removal of the locking pin from the lower leg member notch and manually moving the rigid platform to the desired position and then the locking pin will reinsert automatically on the next notch on each leg.

Each lower leg member includes a flat elongated base support that rests against a lower surface. The length of the lower leg base member is sufficiently long enough to provide a stable support for the entire portable desk. The elongated base which is flat on the bottom on each lower leg member is positioned to be parallel to the side edges of the desk top rigid surface for stability purposes. The length of the base member of each lower leg is such that it is sufficiently long enough to support the desktop support surface regardless of the pitch angle that is established using the stopper locking pin system.

A flat rigid surface having a pair of attaching tabs which is useful as a support or mouse platform can be attached to either side of the outside portion of the lower leg member and is essentially horizontally supported. The user can place objects on this support platform and operate a computer mouse.

It is an object of this invention to provide a portable desk that allows for the desk support surface to be changed in pitch angle easily and quickly.

It is another object of this invention to provide a portable desk that is useful for supporting a laptop or notebook computer and can be used in a variety of environments including while sitting up or lying down in bed.

And yet another object of this invention is to provide a portable desk that can be easily disassembled and that has a pair of legs mounted in a circular track for changing the pitch and angle of the desk top surface manually and easily.

These and other objects of the invention will be easily recognizable to one of ordinary skill in the art.

BRIEF DESCRIPTION OF THE DRAWINGS

FIG. 2 is shown in the lowest or stored position.

PREFERRED EMBODIMENT OF THE INVENTION

Figure 1:
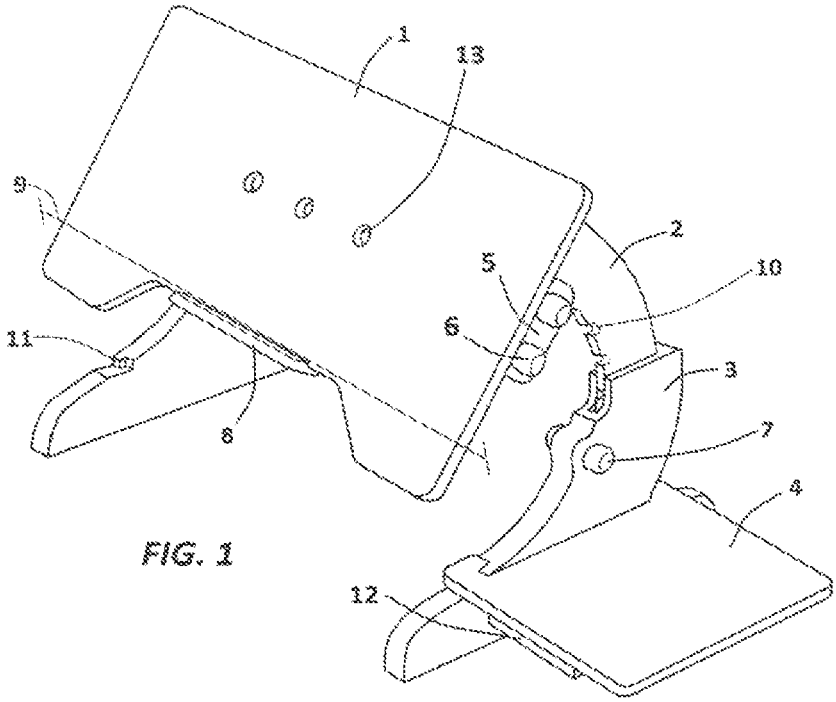
FIG. 1 is a perspective view of the invention.
Figure 2:
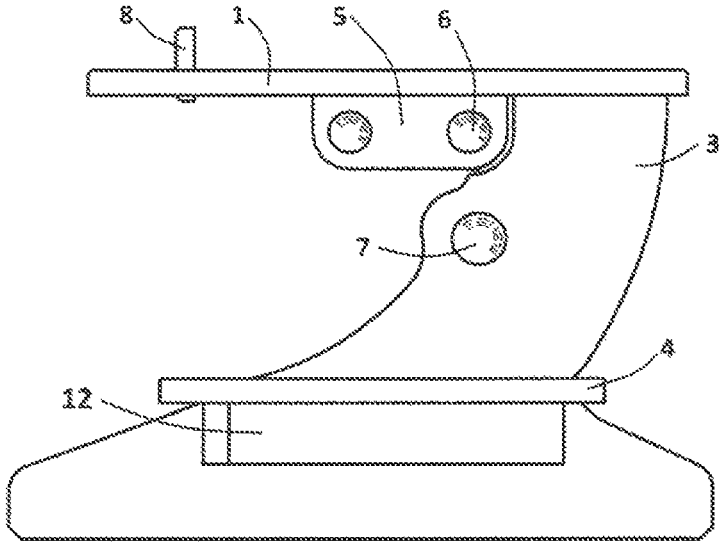
FIG. 2 is a side elevation view of the invention in cross-section through one of the legs of the invention.

Referring now to the drawings and in particular FIG. 1 and FIG. 2, the portable desk is shown comprising a desk top 1 that is substantially made of a rigid material such as wood or plastic, is flat and has a flat surface and is substantially rectangular in shape. The central area of the desk top 1 includes vent holes 13 for air circulation. The bottom edge of the desk top 1 may include a central recessed area.

The portable desk includes a pair of lower legs 3 which are curved and a pair of upper legs 2 which are also curved and which also fit telescopically inside a channel in the lower legs 3.

Each lower leg 3 has an elongated flat bottom for supporting the portable desk in an upright position. Each lower leg 3 has an internal arcuate channel that is sized to receive the curved upper leg 2 which is attached at one end to the desk top 1. The desk top 1 includes on each side on its back surface a mounting block 5 that receives locking pins 6 on each side which firmly attach the desk top 1 to the pair of upper legs 2. The pitch angle of the desk top 1 can be manually changed by removal of stopper 7 in the manual manipulation of the desk top 1 and upper arms 2 to the desired location subject to alignment of a notch 10 located on each leg 2. Once the desired position of desk top 1 is achieved and the alignment of the notch 10, the stopper 7 is reinserted into the upper leg 2.

The desk top 1 also includes a bumper or ledge 8 which is used to stop or support a laptop computer or other object positioned on the top surface of desk top 1. Also shown in FIG. 1, a mouse pad 4 is interlocked with the right side lower leg 3 in a horizontal position. The mouse pad 4 also includes a drawer 12 that can be pulled open in the front. Each lower leg 3 includes a mouse pad holder mounting the recess 11 on each side which allows the mouse pad 4 to be mounted either on the right side of the portable desk or the left side of the portable desk.

Figure 3:
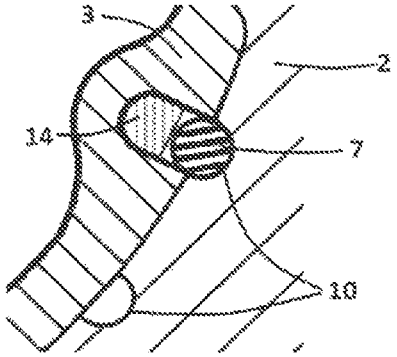
FIG. 3 shows a side elevation view in cross-section through a leg of the invention with the desk top surface race through approximately a 30° angle using a locking pin.
Figure 4:
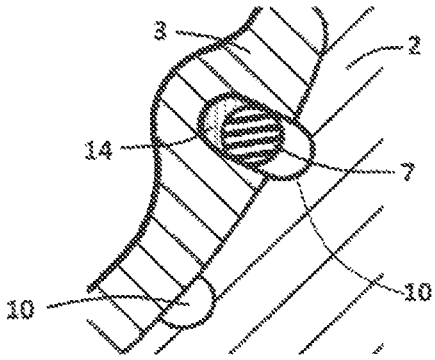
FIG. 4 shows a cutaway view inside elevation and in cross-section of a locking pin in a specific position for locking the upper leg to the lower leg.

FIG. 3 shows a stopper 7 mounted in a groove or notch 10 that locks upper leg 2 in a fixed position with the aid of a rubber spring 14. FIG. 4 shows the stopper manually pushed against rubber spring 14 removing the stopper 7 from groove or notch 10 which would allow manual movement of upper arm 3 to allow positioning the desk top 1 to a desired pitch angle.

Figure 5:
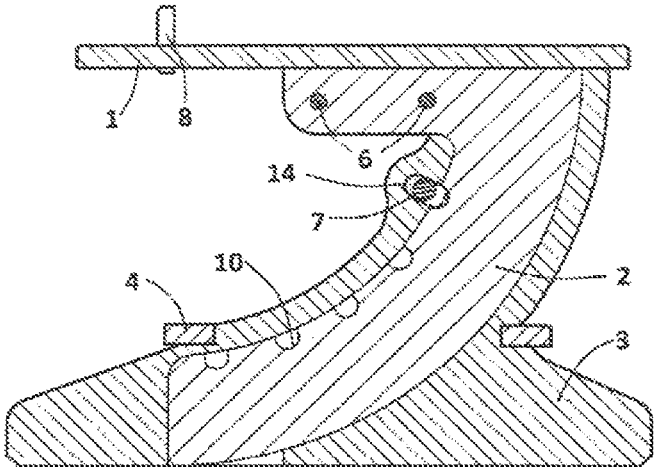
FIG. 5 shows a cutaway view of the locking pin in cross-section inside elevation in a different position than that shown in FIG. 4.

FIG. 5 shows the desk top 1 in a horizontal position such that the upper leg 2 is positioned completely within the channel formed in the lower leg 3. The pins 6 attach the desk top 1 to upper leg 2 that are removable in order to disassemble the portable desk. FIG. 5 also shows segments of the mouse pad holder 4 engaged with the lower leg 3. The notches 10 can be used in conjunction with stopper 7 to adjust manually upper leg 2 to change the pitch angle of the desk top 1 by selecting a particular notch 10 in conjunction with stopper 7.

Figure 6:
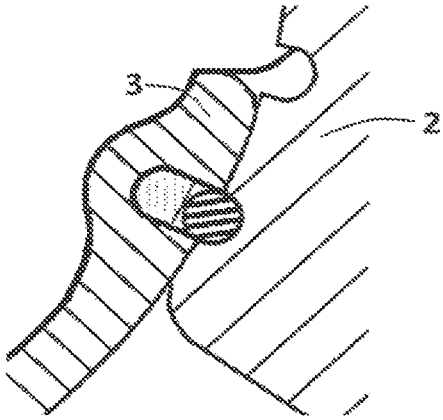
FIG. 6 shows a cutaway view in elevation cross-section of the position of the locking pin as shown in FIG. 3.
Figure 7:
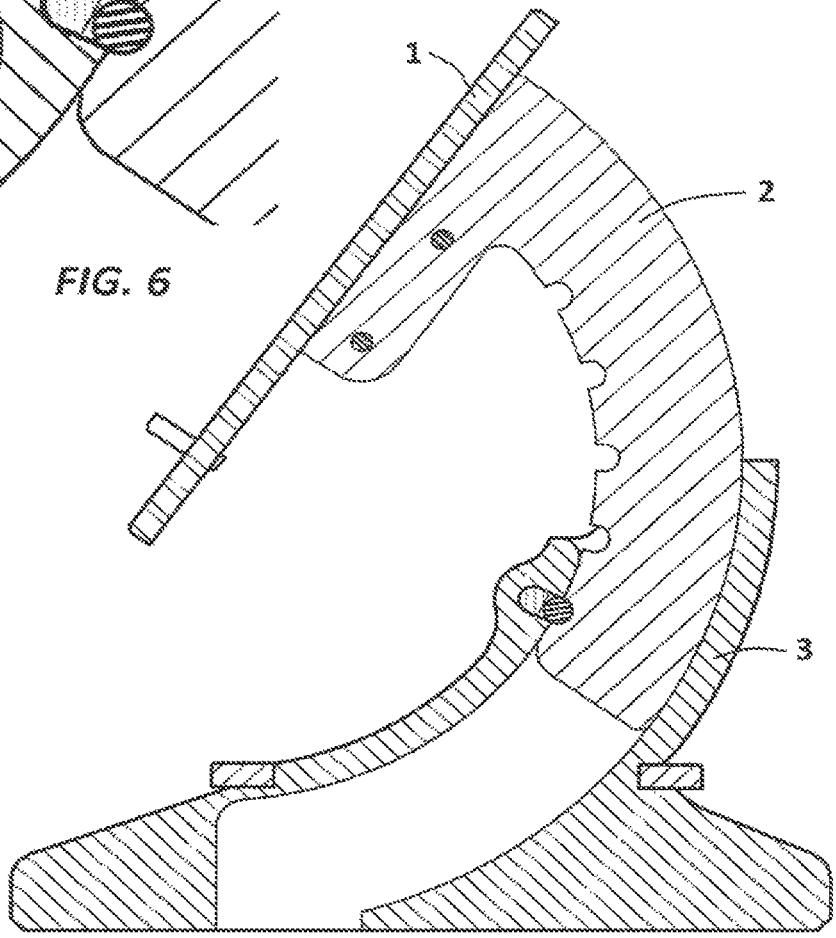
FIG. 7 shows a side elevation in cross-section with the desktop raised to its maximum height.

FIG. 6 and FIG. 7 show the portable desk with the desk top 1 in the fully extended pitch angle position of approximately 55° such that upper leg 2 has been moved relative to lower leg 3 and locked in place by stopper 7.

Figure 8:
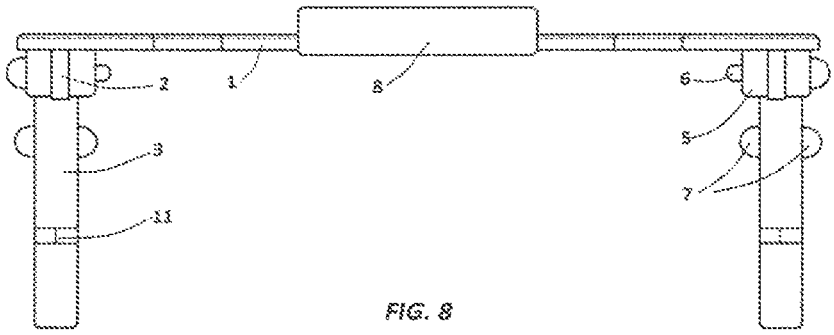
FIG. 8 shows the rear elevation view of the portable desk with the desktop in the lowest position.
Figure 9:
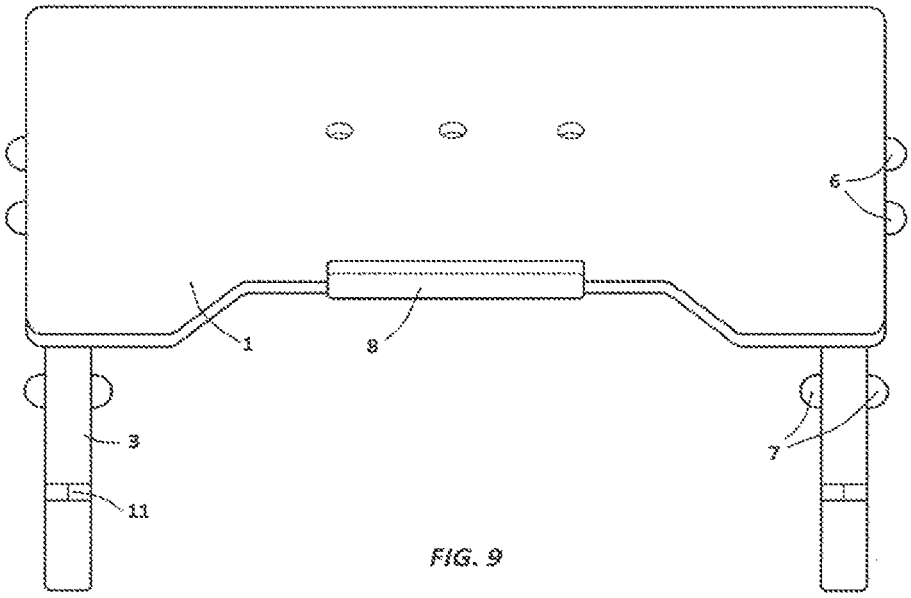
FIG. 9 shows a rear elevation view with the desk top in the raised maximum position.

FIG. 8 shows a rear elevation view of the portable desk with the desk top 1 in the horizontal position. The mounting block 5 is attached firmly to the desk top 1 and includes apertures which allow for pins 6 to be secured to the upper end of upper leg 2.

An important feature of the invention is that it is extremely portable and relatively light weight to provide a desk surface that can be used in various environments including sitting up and lying down in bed. The device is especially useful for supporting a laptop computer comfortably and includes a mouse pad. Another important feature is the ability to change the pitch angle of the desk top surface manually in a relatively easy fashion. The portable desk can also be disassembled and stored easily for portability and travel.

The instant invention has been shown and described herein in what is considered to be the most practical and preferred embodiment. The applicant recognizes, however, that departures may be made therefrom within the scope of the invention and that obvious modifications will occur to a person skilled in the art.

What I claim is:

1. A portable desk comprising:

a rigid planar flat surface desk top sized in length and width to support a laptop computer;

said desk top having a flat front surface and a flat back surface;

said desk top having a top straight edge and a bottom edge;

a pair of lower legs, each lower leg having a substantially curved longitudinal shape and each lower leg defining an internal curved chamber;

a pair of upper legs, each upper leg having a substantially curved longitudinal shape, each upper leg attached to a different lower leg and mounted within a chamber of each lower leg and movable within;

each lower leg including a supporting base surface sufficiently long enough to provide a stable support for said portable desk;

each of said upper legs including a distal end and a proximal end, said upper leg proximal ends attached to said desk top flat back surface adjacent to the top edge to define first and second upper leg attachments, and said upper leg distal ends mounted inside said lower leg chambers, such that each of said upper legs extends downwardly and away from said leg attachment toward the bottom edge; and a stopper connected to each said lower leg;

each of said upper legs having a curved body surface that includes a plurality of notches, each notch sized to engage said stopper, each of said upper leg notches disposed a predetermined distance apart from each other along said upper leg surface, said stopper being manually movable from a first position outside of any of the upper leg notches to a second position engaged within one upper leg notch for adjusting manually the pitch angle of the desk top based on the specific location of the stopper with respect to a specific upper leg notch; and said desk top back surface being free of any other attachments except said proximal ends of said first upper leg and said second upper leg attachments.

2. A portable desk as in claim 1 including:

a mouse pad holder horizontally mountable to at least one lower leg for receiving a computer mouse.

3. A portable desk as in claim 1, wherein said desk top includes a bumper located along its lower edge.

4. A portable desk as in claim 1 wherein each said upper leg attachment comprises:

at least one pin connectable to at least one upper leg and to said desk top for connecting said desktop to said upper leg.

5. A portable desk as in claim 1, wherein:

said desk top bottom edge having a central recessed area.

* * * * *